US007082703B2

(12) United States Patent
Greene et al.

(10) Patent No.: US 7,082,703 B2
(45) Date of Patent: Aug. 1, 2006

(54) ARTICLE OF FOOTWEAR FOR SAND SPORTS

(75) Inventors: Pamela S. Greene, Portland, OR (US); Tobie D. Hatfield, Lake Oswego, OR (US)

(73) Assignee: Nike, Inc., Beaverton, OR (US)

( * ) Notice: Subject to any disclaimer, the term of this patent is extended or adjusted under 35 U.S.C. 154(b) by 63 days.

(21) Appl. No.: 10/768,722

(22) Filed: Jan. 30, 2004

(65) Prior Publication Data

US 2005/0166427 A1 Aug. 4, 2005

(51) Int. Cl.
*A43B 7/20* (2006.01)

(52) U.S. Cl. ..... 36/89; 36/94; 36/128; 36/58.6; 36/9 R

(58) Field of Classification Search ..... 36/89, 36/94, 128, 9 R, 58.5, 58.6; 602/66, 27
See application file for complete search history.

(56) References Cited

U.S. PATENT DOCUMENTS

| | | | | | |
|---|---|---|---|---|---|
| 2,147,197 | A | * | 2/1939 | Glidden | 36/9 R |
| 2,932,829 | A | * | 4/1960 | Corbin | 2/239 |
| 3,013,564 | A | * | 12/1961 | Levey | 36/170 |
| 4,276,671 | A | * | 7/1981 | Melton | 12/142 T |
| 4,461,288 | A | * | 7/1984 | Curtis | 602/23 |
| D288,742 | S | * | 3/1987 | Caretti | D2/924 |
| 5,526,584 | A | * | 6/1996 | Bleimhofer et al. | 36/10 |
| D385,102 | S | * | 10/1997 | Avar | D2/972 |
| 5,676,641 | A | * | 10/1997 | Arensdorf et al. | 602/27 |
| 5,689,903 | A | * | 11/1997 | Aumann | 36/77 R |
| 5,692,319 | A | | 12/1997 | Parker et al. | 36/50.1 |
| 5,819,439 | A | * | 10/1998 | Sanchez | 36/89 |
| D444,940 | S | * | 7/2001 | Murrey | D2/989 |
| 2002/0078599 | A1 | * | 6/2002 | Delgorgue et al. | 36/98 |

FOREIGN PATENT DOCUMENTS

| | | |
|---|---|---|
| DE | 39 10 294 | 10/1990 |
| EP | 0 152 033 | 8/1985 |
| EP | 0 447 231 A1 | 9/1991 |
| EP | 1 033 086 A1 | 9/2000 |
| GB | 2 162 043 A | 1/1986 |

OTHER PUBLICATIONS

International Search Report for application No.: PCT/US2005/002256.
Website for Vincere Sand Sock, sandsocks.iwarp.com, date: unknown.

* cited by examiner

*Primary Examiner*—Ted Kavanaugh
(74) *Attorney, Agent, or Firm*—Banner & Witcoff, Ltd.

(57) ABSTRACT

An article of footwear for sand sports includes an outsole and an upper secured to the outsole. The upper has a first toe pocket configured to receive a big toe of a user and a second toe pocket configured to receive at least some of the remaining toes of the user. A wrap extends around a midfoot portion of the outsole and the upper, and around a heel portion of the upper. A plurality of cleats may be secured to a lower surface of the outsole.

42 Claims, 7 Drawing Sheets

ARTICLE OF FOOTWEAR FOR SAND SPORTS

FIELD OF THE INVENTION

This invention relates generally to an article of footwear, and, in particular, to an article of footwear for use in sand sports.

BACKGROUND OF THE INVENTION

When playing competitive sand sports, such as volleyball or soccer, the players often do not wear shoes. The proprioceptive sensory feedback from the bare foot is invaluable for the positioning of the players' feet in the uneven and shifting semi-fluid medium of sand. Additionally, players need to use their toes to dig for positioning, and to enhance their grip for traction. However, many non-optimum sand conditions, such as hot and cold temperature extremes, abrasive sand, and sharp particles found in the sand, require the usage of a foot covering for the purposes of protection.

The ability to maintain independent toe movement is found in traditional Japanese split-toed carpentry shoes, which deliver the benefit of increasing balance since the toes can position themselves semi-independently. These shoes have a toe pocket design that allows for the independent movement of the 1$^{st}$ digit, commonly referred to as the big toe, and the remaining 4 digits or toes of the user's foot. However, such shoes do not have the flexibility required for sand sports.

The current marketplace offers a wide variety of aquatic sport environment footwear offerings with traditional uppers and outsoles constructed with firm rubber. In addition, current models of surf and sailboard booties constructed of neoprene and firm rubber pieces have the split toe feature. However, none of these products would allow for the natural barefoot proprioceptive feedback required for performance level sport play in the medium of sand.

Traditionally, sand volleyball players have solved their protection requirements by wearing common knit socks. Specialized socks for the sport of volleyball are currently offered in the marketplace. These consist of a single sock foot volume, and may have an additional protective layer of neoprene used as the sole.

One problem with wearing a single volume traditional sock is that the sock shifts and slips in relation to the foot, especially in area of the toes, when forces are exerted during play. This slipping is distracting to the players and leaves them unable to efficiently position themselves, which compromises play. Another problem is that the single volume sock does not allow the individual toes to dig, grip and balance in the shifting semi-fluid medium of sand, as compared to the optimum condition of the bare foot.

It is an object of the present invention to provide an article of footwear for sand sports that reduces or overcomes some or all of the difficulties inherent in prior known devices. Particular objects and advantages of the invention will be apparent to those skilled in the art, that is, those who are knowledgeable or experienced in this field of technology, in view of the following disclosure of the invention and detailed description of certain preferred embodiments.

SUMMARY

The principles of the invention may be used to advantage to provide an article of footwear suitable for sand sports that provides protection from non-optimum sand conditions while allowing for the natural movement of the foot necessary for proprioceptive feedback that would be compromised by wearing a shoe with a firm rubber outsole construction.

In accordance with a first aspect, an article of footwear for sand sports includes an outsole and an upper secured to the outsole. The upper has a first toe pocket configured to receive a big toe of a user and a second toe pocket configured to receive at least some of the remaining toes of the user. A wrap extends around a midfoot portion of the outsole and the upper, and around a heel portion of the upper.

In accordance with another aspect, an article of footwear for sand sports includes an outsole and an upper secured to the outsole. The upper has a first toe pocket configured to receive a big toe of a user and a second toe pocket configured to receive at least some of the remaining toes of the user. A wrap extends around a midfoot portion of the outsole and the upper, and around a heel portion of the upper. A strap has a first end secured to a medial side of the wrap and a second end releasably secured to a lateral side of the wrap. A plurality of cleats is secured to the outsole.

In accordance with a further aspect, an article of footwear for sand sports includes an outsole and an upper secured to the outsole. The upper has a first toe pocket configured to receive a big toe of a user and a second toe pocket configured to receive at least some of the remaining toes of the user. A collar is positioned on an upper edge of the upper. A polymer coating is located on an interior surface of the collar. A wrap extends around a midfoot portion of the outsole and the upper, and around a heel portion of the upper. A strap has a first end secured to a medial side of the wrap and a second end releasably secured to a lateral side of the wrap by a fastener. A plurality of cleats is secured to the outsole.

Substantial advantage is achieved by providing an article of footwear for sand sports. In particular, articles of footwear for sand sports in accordance with the present invention allow a user's toes to move somewhat independently, providing increased balance and traction in the sand, superior footing, and protection for the user's foot, as well as reduced internal slippage.

These and additional features and advantages of the invention disclosed here will be further understood from the following detailed disclosure of certain preferred embodiments.

Figure 1:
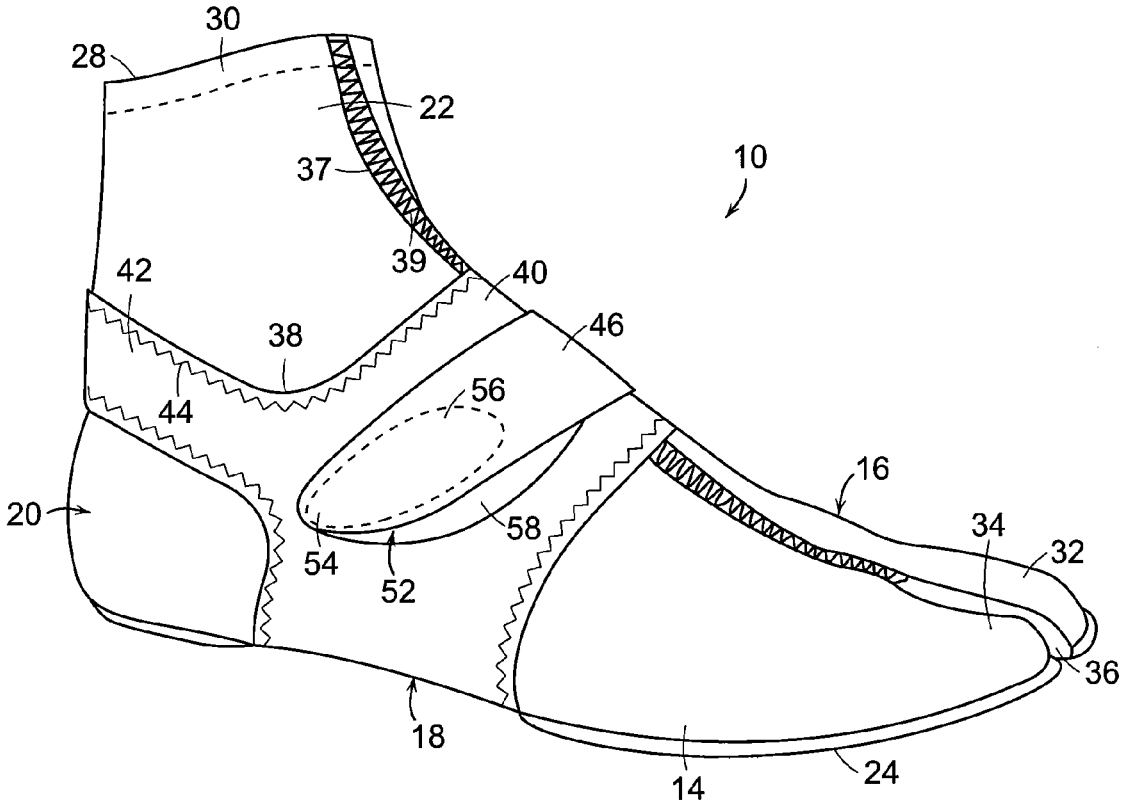
FIG. 1 is a perspective view of the lateral side of a preferred embodiment of an article of footwear for sand sports in accordance with the present invention.

The figures referred to above are not drawn necessarily to scale and should be understood to present a representation of the invention, illustrative of the principles involved. Some features of the article of footwear for sand sports depicted in the drawings have been enlarged or distorted relative to others to facilitate explanation and understanding. The same reference numbers are used in the drawings for similar or identical components and features shown in various alternative embodiments. Articles of footwear for sand sports as disclosed herein would have configurations and components determined, in part, by the intended application and environment in which they are used.

DETAILED DESCRIPTION OF CERTAIN PREFERRED EMBODIMENTS

Figure 2:
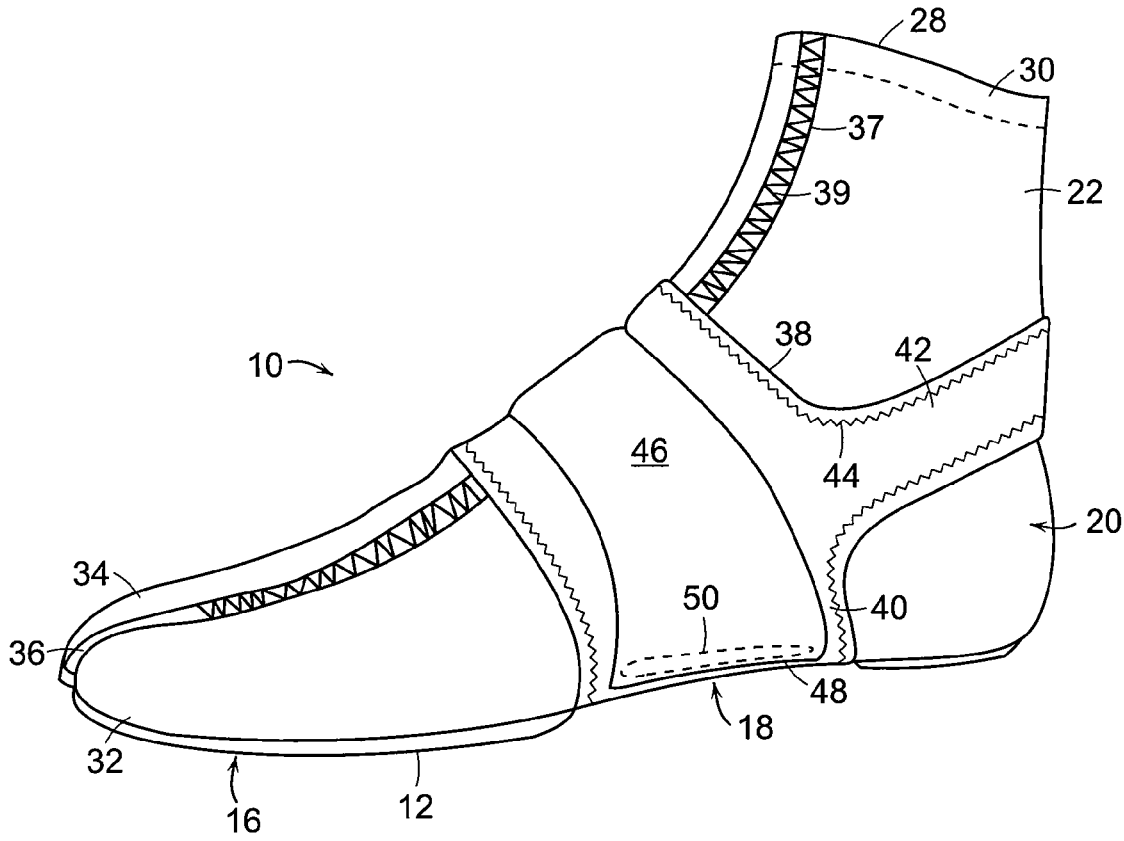
FIG. 2 is a perspective view of the medial side of the article of footwear of FIG. 1.
Figure 3:
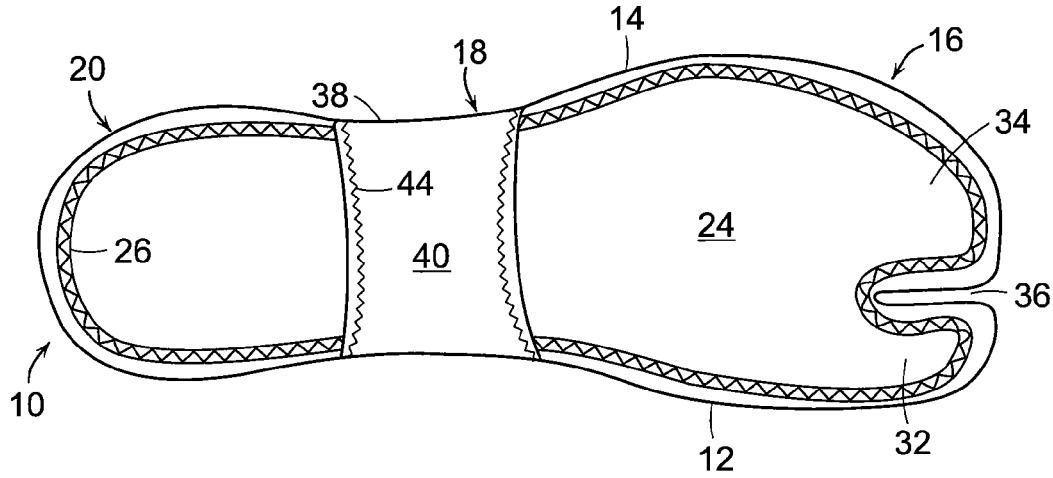
FIG. 3 is a bottom plan view of the article of footwear of FIG. 1.

The present invention may be embodied in various forms. A preferred embodiment of an article of footwear 10 is shown in FIGS. 1–3. Footwear 10 has a medial, or inner, side 12 and a lateral, or outer, side 14. For purposes of general reference, footwear 10 may be divided into three general portions: a forefoot portion 16, a midfoot portion 18, and a heel portion 20. Portions 16, 18, and 20 are not intended to demarcate precise areas of footwear 10. Rather, portions 16, 18, and 20 are intended to represent general areas of footwear 10 that provide a frame of reference during the following discussion.

Unless otherwise stated, or otherwise clear from the context below, directional terms used herein, such as rearwardly, forwardly, inwardly, downwardly, upwardly, etc., refer to directions relative to footwear 10 itself. Footwear 10 is shown in FIG. 1 to be disposed substantially horizontally, as it would be positioned on a horizontal surface when worn by a wearer. However, it is to be appreciated that footwear 10 need not be limited to such an orientation. Thus, in the illustrated embodiment of FIG. 1, rearwardly is toward heel portion 20, that is, to the left as seen in FIG. 1. Naturally, forwardly is toward forefoot portion 16, that is, to the right as seen in FIG. 1, and downwardly is toward the bottom of the page as seen in FIG. 1. Inwardly is toward the center of footwear 10, and outwardly is toward the outer peripheral edge of footwear 10.

Footwear 10 includes an upper 22, and an outsole 24 secured at least about its peripheral edge to upper 22. As seen in FIG. 3, outsole 24 may be secured to upper 22 by way of stitching 26. In other preferred embodiments, outsole 24 may be secured to upper 22 by an adhesive, or any other suitable fastener. Outsole 24 is preferably a flexible insulating material such as neoprene foam, closed cell foams, polyether and polyester based PU foams, thermoplastic foams, or polymer blends incorporating expanding polymeric or glass microspheres. In certain preferred embodiments, outsole 24 is formed of a material that would not increase in weight by soaking up water or trapping sand particles. In other preferred embodiments, an insulating foam may be laminated together with a textile covering or secondary polymer coating, thereby providing an additional durable covering to prevent abrasion and wear. Other suitable materials for outsole 24 will become readily apparent to those skilled in the art, given the benefit of this disclosure.

Upper 22 may take the form of a bootie, rising above the ankle of the wearer, terminating in a collar 28, which is preferably positioned above the medial malleolus, or inner ankle bone, of the user, thereby providing a gapless gasket seal above the user's ankle. In preferred embodiments, upper 22 is formed of a flexible textile material, which can easily stretch about and conform tightly to the user's foot. In preferred embodiments, this textile can be made of such a gauge or density that sand particles do not readily enter the spaces in between the yarns. Upper 22 may be formed of, for example, knit, woven or non-woven material made using fibers such as, but not limited to, nylon, polyester, polyurethane and or spandex, with elastomeric properties. Textiles with ultraviolet light protection qualities may be used, and textiles with the capability of allowing the wearer to tan through them may also be used. Other suitable materials for upper 22 will become readily apparent to those skilled in the art, given the benefit of this disclosure.

In a preferred embodiment, a coating 30 is applied around an inside upper peripheral edge of collar 28. Coating 30 may be an elastomeric and tacky polymer, such as, but not limited to polyurethane (PU), silicone, nylon, polyester, or an acrylic based polymer. Coating 30 serves to allow the edge of collar 28 to be finished without a binding to reduce fraying, to help collar 28 adhere to the skin of the user in order to minimize the amount of sand entering footwear 10, and to capture any grains of sand that may work their way inside footwear 10. A protective coating may also be applied to seams and/or stitching on other portions of footwear 10 for the purpose of durability and to prevent the textile from fraying. For example, stitching 26 that secures outsole 24 to upper 22 may have such a coating. Additionally, coatings may also be applied to the textile upper, either internally or externally, to provide enhanced textile durability in high wear areas such as, but not limited to, the areas above and beneath the toe pockets, and the instep. Additionally, the upper and outsole may have external polyurethane or silicone coatings to provide regional properties such as tacky grip for improved ball control, as described in greater detail below.

A first toe pocket 32 is positioned on medial side 12 of forefoot portion 16 of upper 22, and is configured to house the user's big toe. A second toe pocket 34 is positioned in forefoot portion 16, and is configured to house the user's remaining toes. Second toe pocket 34 is spaced from first toe pocket 32 by a slot 36. Toe pockets 32, 34 reduce the internal movement, or slipping, of the user's foot, since the big toe and remaining toes are confined within separate pockets, unlike that of a conventional single volume sock. Additionally, toe pockets 32, 34 facilitate the ability of the user's individual toes to grip the sand and provide balance, thereby optimizing positioning of the user's feet during play.

In certain preferred embodiments, upper 22 includes a seam 37 extending from slot 36 up to collar 28. Stitching 39 extends along seam 37 and serves to secure medial 12 and lateral 14 portions of upper 22 together. The existence of seam 37 is a result of the way that upper 22 is manufactured. Consequently, it is to be appreciated that a seam may be positioned elsewhere on upper 22, and in alternative embodiments, upper 22 may be seamless.

A midfoot wrap 38 includes a first portion 40 that extends across the instep of upper 22 and over outsole 24, enveloping midfoot portion 18 of footwear 10. A second portion 42 of wrap 38 extends around the rear of upper 22, above the heel and below the ankle. Wrap 38 may be secured to upper 22 by way of stitching 44, welding or adhesives. In other preferred embodiments, wrap 38 may be secured to upper 22 by an adhesive, or any other suitable fastener. In preferred embodiments, wrap 38 is formed of a stretchy polymer or a polymer and textile composite. Wrap 38 may be formed of, for example, stretchable PU coated synthetics and textiles, or non-woven elastomeric polymer based materials. The location, strength and compressive power of this wrap can be directly engineered into the main upper by way of knitting regional properties into the wrap (for example, through the user of a circular knitting process), in which case the wrap would be seamlessly integrated into the upper as one-piece construction, and not formed as a separate part. Other suitable materials for wrap 38 will become readily apparent to those skilled in the art, given the benefit of this disclosure.

A strap 46 has a first end 48 that is secured to medial side 12 of wrap 38. In the illustrated embodiment, strap 46 is secured to wrap 38 slightly above outsole 24. Strap 46 may be secured to wrap 38 by stitching 50 or other suitable fastening means. Strap 46 extends across an instep of upper 22 to lateral side 14 of midfoot portion 18. A fastener 52 releasably secures strap 40 to wrap 38. In the illustrated embodiment, a second end 54 of strap 40 includes a first portion 56 of fastener 52. A second portion 58 of fastener 52 is secured to wrap 38. Each of first and second portions 56, 58 may be, as illustrated, one of a hook and loop portion of a hook and loop fastener.

Figure 4:
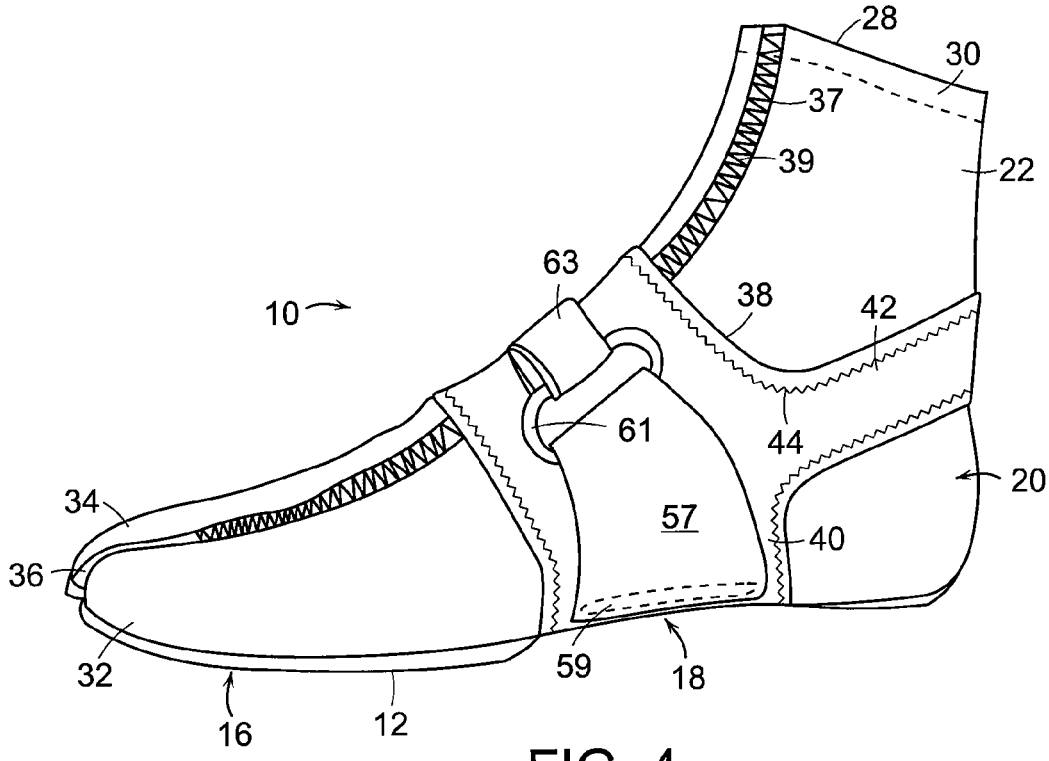
FIG. 4 is a perspective view of the article of footwear of FIG. 1, shown with an alternative strap embodiment.

It is to be appreciated that fastener 52 may take many forms. For example, as seen in FIG. 4, for additional strapping strength, the mechanical advantage of a d-ring configuration could be employed. In this embodiment, strap 40 includes a first portion 57 secured to medial side 12 of wrap 38 by stitching 59 or other suitable fastening means. A d-ring 61 is secured to first portion 57. A second portion 63 of strap 40 has a first end secured to lateral side 14 of wrap 38 by stitching or other suitable fastening means. Second portion 63 passes through d-ring 61, and returns over the top, or instep, of the user's foot, with a second end of second portion 63 being releasably secured on lateral side 14 of wrap 38. The second end of second portion 63 may be secured to the first end with a hook and loop fastener such as fastener 52 described above in connection with FIG. 1 or any other suitable fastening means. It is to be appreciated that in other preferred embodiments, strap 40 could be completely wrapped around the foot rather than just extend across the instep of the user's foot. Other suitable fasteners for strap 46 will become readily apparent to those skilled in the art, given the benefit of this disclosure. Wrap 38 and strap 46 combine to secure the user's foot within the soft and flexible upper 22, thereby reducing internal slippage.

Figure 5:
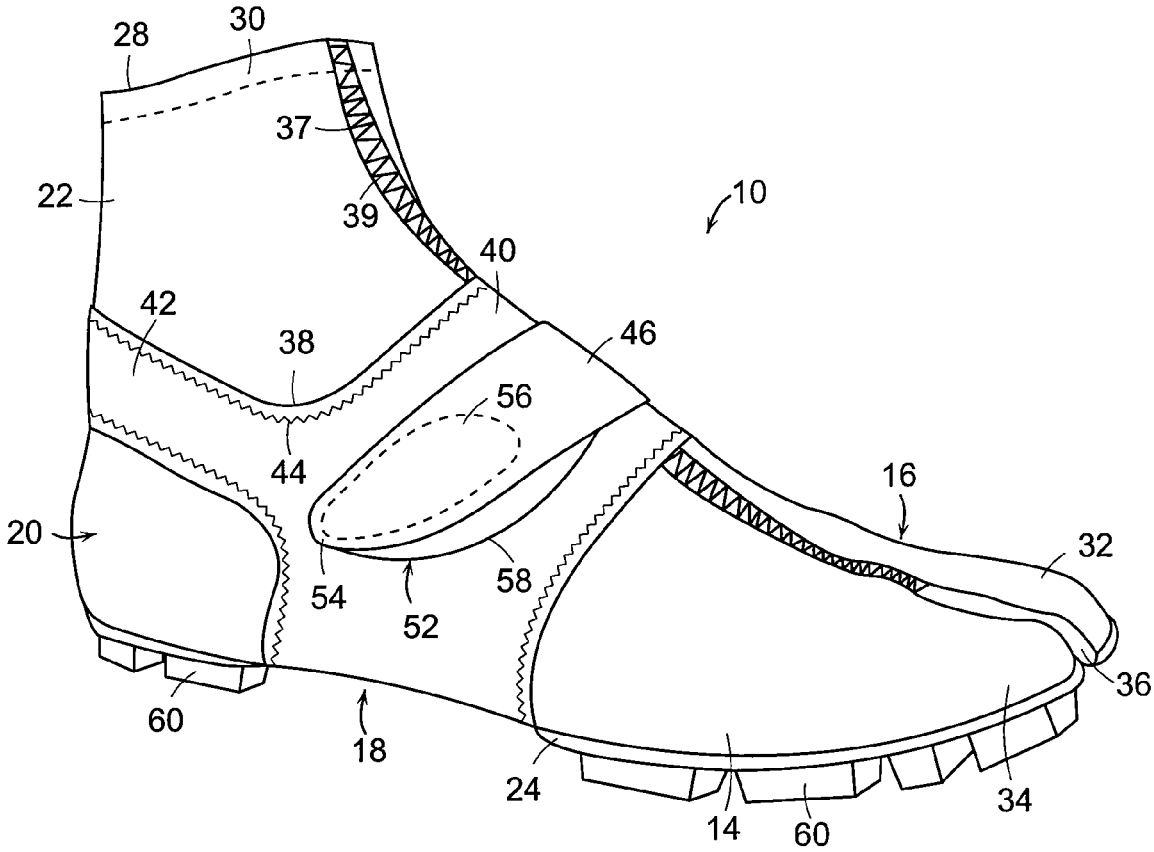
FIG. 5 is a perspective view of an alternative embodiment of an article of footwear for sand sports in accordance with the present invention.
Figure 6:
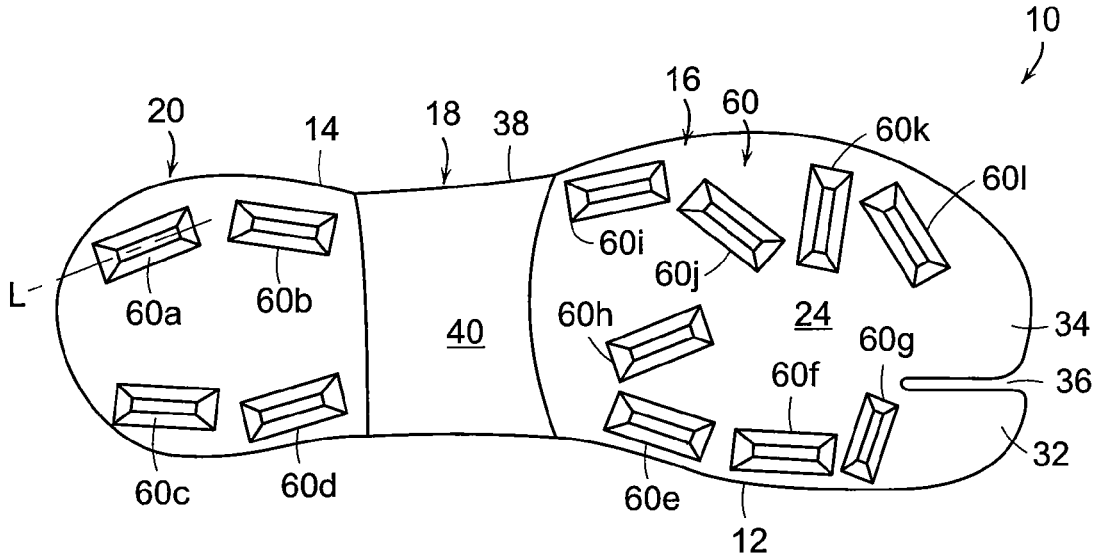
FIG. 6 is a bottom plan view of the article of footwear of FIG. 5.

Another preferred embodiment is shown in FIGS. 5–6, in which a plurality of cleats 60 is secured to outsole 24 to provide increased traction. Cleats 60 preferably are soft to prevent pressure points impacting sole of the user's foot, and to prevent injuries if the cleats come into contact with other players. The cleats may be formed of, for example, foamed polymers such as polyurethane, copolymers: polyetheramides, or polyesteramides, polypropylene, PP/EPDM, Styrenebutadienestyrenes (SBS) or thermoplastic polymers such as urethane, polyetheramides, polyesteramides, or their blends, or cast polymers such as urethane or silicone. These compounds may be used singly or in combination. Additionally, polymers with tactile surface qualities may be used to provide ball grip characteristics.

In a preferred embodiment, cleats 60 formed of foamed polymers have a hardness of less than approximately 50 Asker C and, more preferably, approximately 25 Asker C to 55 Asker C. Cleats 60 formed of plastic polymers preferably have a hardness less than approximately 80 Shore A and, more preferably, approximately 30 Shore A to 80 Shore A. Cleats 60 may be secured to outsole 24 by an adhesive, or formed directly with outsole 24 by injection molding or any other suitable process.

Cleats 60 are preferably arranged on outsole 24 so as to contain loose sand, which helps to prevent the sand from sliding out under the user's foot, and to help keep the user's foot on top of the sand, each of which can help provide a competitive advantage. In the illustrated embodiment, each of cleats 60 has a substantially rectangular configuration with a longitudinal axis L. The rectangular configuration of cleats 60 provides extended surfaces along two sides of each cleat 60, which serve to provide increased surface area, which in turn can provide increase traction for propulsion and braking. It is to be appreciated that in other embodiments, cleats 60 may have other shapes, including, for example, the frustoconical cleats found on many athletic shoes, and that such other shapes are considered to be within the scope of the present invention.

In the illustrated embodiment, a first pair of cleats 60*a*, 60*b* is positioned on lateral side 14 of heel portion 20 of outsole 24. The longitudinal axis L of each cleat 60*a*, 60*b* extends substantially parallel to the edge of lateral side 14 of heel portion 20. A second pair of cleats 60*c*, 60*d* is positioned on medial side 12 of heel portion 20. The longitudinal axis L of each cleat 60*c*, 60*d* extends substantially parallel to the edge of medial side 12 of heel portion 20.

A third pair of cleats 60*e*, 60*f* is positioned on medial side 12 of forefoot portion 16 just forwardly of wrap 38, and the longitudinal axis L of each cleat 60*e*, 60*f* extends substantially parallel to the edge of medial side 12 of forefoot portion 16. An additional cleat 60*g* is positioned on medial side 12 forwardly of third pair 60*e*, 60*f* at the base of first toe pocket 32, and its longitudinal axis L extends substantially perpendicular to the edge of medial side 12. A further cleat 60*h* is positioned on medial side 12 inwardly of the rearmost cleat 60*e* of the third pair, and its longitudinal axis L extends inwardly from its rear end at an angle with respect to rearmost cleat 60*e* of the third pair.

A cleat 60*i* is positioned on lateral side 14 of forefoot portion 16 just forwardly of wrap 38, and its longitudinal axis L extends substantially parallel to the edge of lateral side 14 of forefoot portion 16. A further cleat 60*j* is positioned just forwardly of cleat 60*i* and extends inwardly from its rear end at an angle with respect to the edge of lateral side 14. A cleat 60*k* is positioned forwardly of cleat 60*j*, and its longitudinal axis L extends substantially perpendicular to the edge of lateral side 14 of forefoot portion 16. A final cleat 60*l* is positioned forwardly of cleat 60*k*, at the base of toe pocket 34, and extends inwardly from its rear end at an angle with respect to the edge of lateral side 14.

It is to be appreciated that the layout of cleats 60 described above is just one of many configurations that are possible in accordance with, and considered to within the scope of, the present invention.

Figure 7:
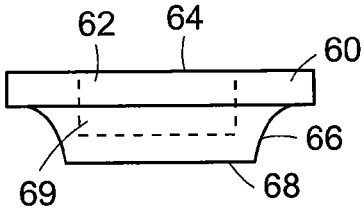
FIG. 7 is a side elevation view of a cleat of the article of footwear of FIG. 5.

In a preferred embodiment, as illustrated in FIG. 7, cleats 60 include a base portion 62 having a planar surface 64 that is secured to outsole 24. A sidewall 66 extends from base portion 62 to a tip 68 of cleat 60. Tip 68 preferably has a smaller surface area than base portion 62 to help ensure that wet sand does not clump, or accumulate, between the cleats.

Figure 8:
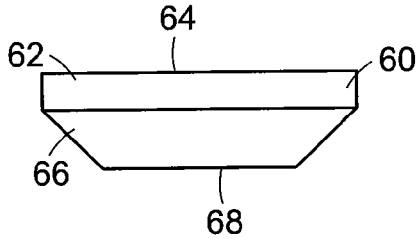
FIG. 8 is a side elevation view of an alternative embodiment of a cleat of the article of footwear of FIG. 5.

In the illustrated embodiment, sidewall 66 is concave inwardly, providing additional surface area and traction. It is to be appreciated that the radius of sidewall 66 should be sized large enough so as to prevent wet sand from clumping, or accumulating, between cleats 60. In another preferred embodiment, as seen in FIG. 8, sidewall 66 extends in a straight line from base portion 62 to tip 68. It is to be appreciated that sidewall 66 may have any configuration that helps to provide traction, while minimizing the accumulation of sand between cleats 60.

In certain preferred embodiments, as illustrated in FIG. 7, cleat 60 may include a central core 69 having a hardness that is higher than the remaining outer portion of cleat 60. The harder, stiffer central core 69 provides added rigidity and strength to cleat 60, while the softer, more resilient outer portion still reduces that chance of injuries if the cleats come into contact with other players. Central core 69 may be formed of any suitable hard material, including, for example, plastic or metal. Suitable materials for central core 69 will become readily apparent to those skilled in the art, given the benefit of this disclosure.

Figure 9:
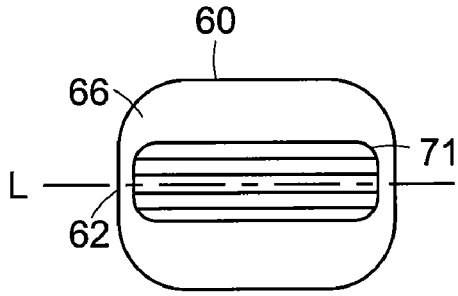
FIG. 9 is a top plan view of another alternative embodiment of a cleat of the article of footwear of FIG. 5.
Figure 10:
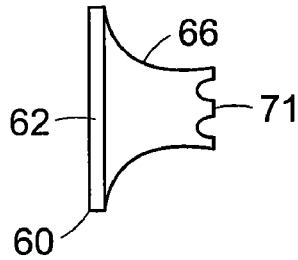
FIG. 10 is a side elevation view of the cleat of FIG. 9.

In certain preferred embodiments, as illustrated in FIGS. 9–10, cleat 60 may include a plurality of protrusions 71 on its exterior surface. These protrusions create increased surface area that increases the user's grip on the ball. The protrusions can act independently of one another, thereby allowing the cleat to contour to the radius of the ball. In the illustrated embodiment, protrusions 71 take the shape of ridges 71, extending longitudinally along the length of cleat 60, substantially parallel to longitudinal axis L.

It is to be appreciated that cleats 60 and protrusions 71 may have any desired shape and size. In a preferred embodiment, base 62 of cleats 60 has a length of approximately 24 mm and a width of approximately 18 mm, with cleat 60 narrowing to a width of approximately 6.5 mm and a length of approximately 19 mm at its top. As illustrated here, ridges 71 have a height of approximately 2 mm. Additionally, the edges of ridges 71 may be rounded off to help grip a ball, and in the illustrated embodiment, the edges of ridges 71 are rounded off with a radius of approximately 0.5 mm.

Figure 11:
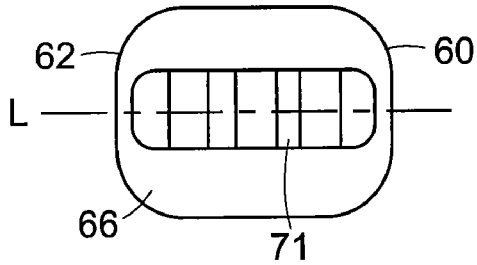
FIG. 11 is a top plan view of another alternative embodiment of a cleat of the article of footwear of FIG. 5.
Figure 12:
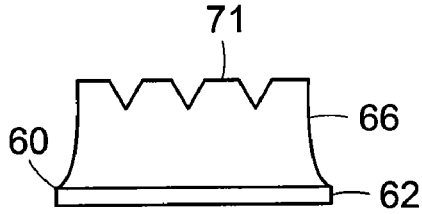
FIG. 12 is a side elevation view of the cleat of FIG. 11.

Another embodiment is illustrated in FIGS. 11–12, in which ridges 71 extend transversely across cleat 60, substantially perpendicular to longitudinal axis L. As illustrated here, ridges 71 have a height of approximately 3 mm. It is to be appreciated that ridges 71 may extend in any direction along cleat 60, including at any angle with respect to longitudinal axis L. Additionally, ridges 71 may be formed in a crisscross, or intersecting pattern.

Figure 13:
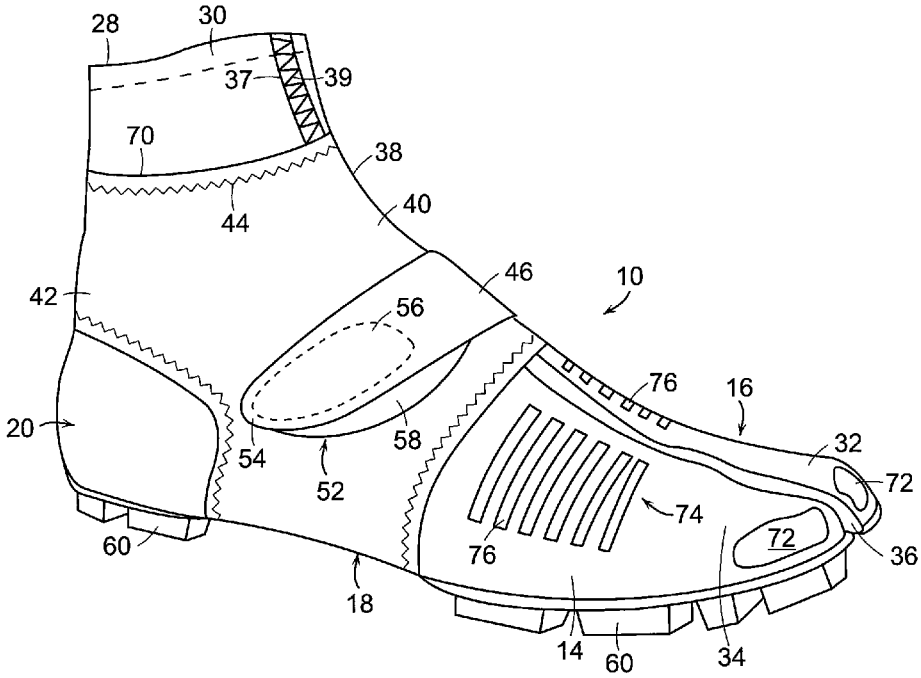
FIG. 13 is a perspective view of an alternative embodiment of an article of footwear for sand sports in accordance with the present invention.

Another preferred embodiment is shown in FIG. 13, in which an upper edge 70 of first and second portions 40, 42 of wrap 38 extends higher along the user's lower leg than the embodiment illustrated in FIGS. 1, 2, 4, and 5, providing more support for the user's ankle, which can be especially helpful for sports such as sand soccer.

Figure 14:
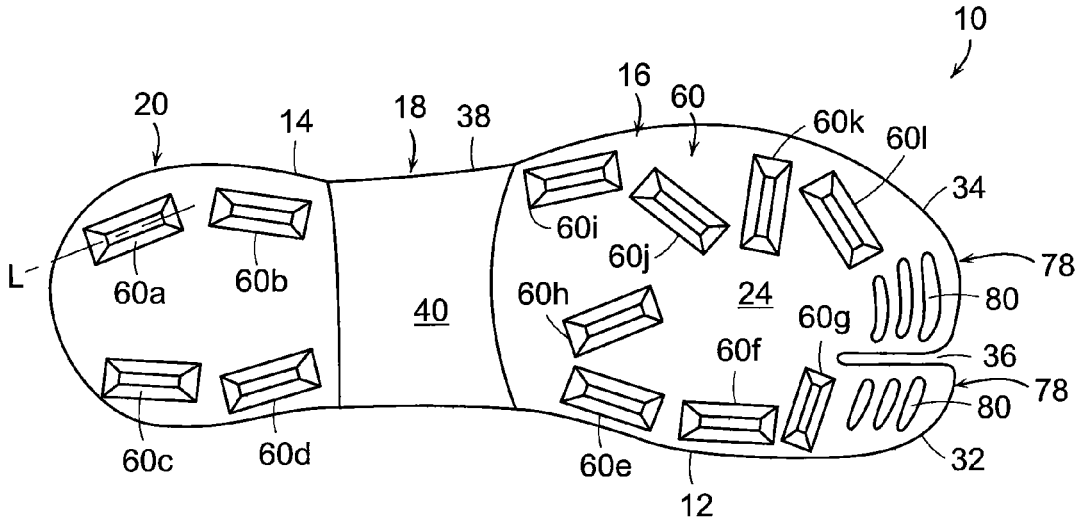
FIG. 14 is a bottom plan view of an alternative embodiment of an article of footwear for sand sports in accordance with the present invention.

As illustrated in FIG. 13, a coating 72 may be provided on first toe pocket 32 and second toe pocket 34 above the user's toes. A coating 74 may also be provided on the instep of footwear 10. In the illustrated embodiment, coating 74 takes the form of a plurality of strips 76 of the coating material. As illustrated in FIG. 14, a coating 78 may be provided on the bottom of first toe pocket 32 and second toe pocket 34. In the illustrated embodiment, coating 78 takes the form of a plurality of strips 80 of the coating material.

These coatings provide enhanced durability in high wear areas of footwear 10, and may also provide enhanced grip through the use of a tacky coating, which provides improved ball control. Exemplary materials for coatings 72, 74, 78 include polyurethane and silicone. Other suitable materials for coatings 72, 74, 78 will become readily apparent to those skilled in the art, given the benefit of this disclosure.

Figure 15:
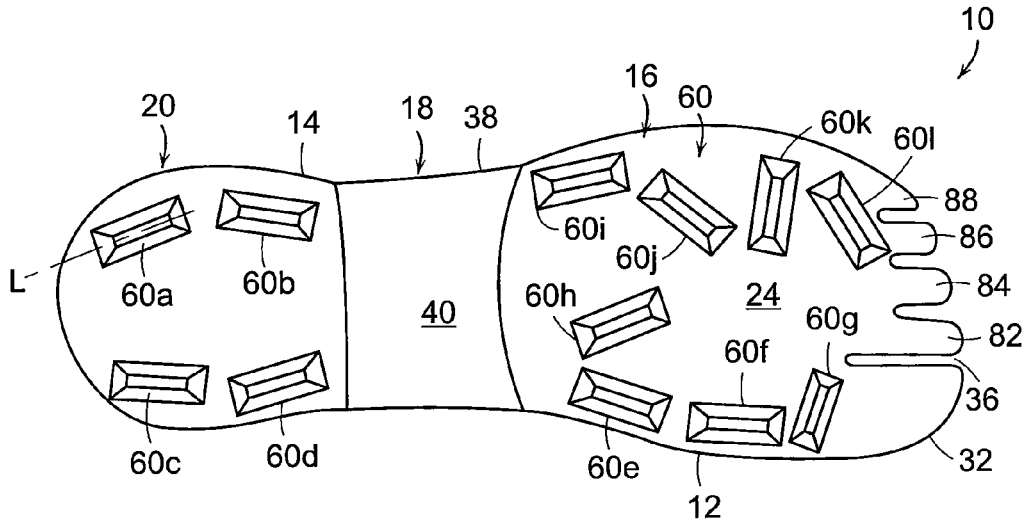
FIG. 15 is a bottom plan view of another alternative embodiment of an article of footwear for sand sports in accordance with the present invention.

In other embodiments, as illustrated in FIG. 15, more than two toe pockets can be provided. As seen here, footwear 10 includes first toe pocket 32, a second toe pocket 82, a third toe pocket 84, a fourth toe pocket 86, and a fifth toe pocket 88, thereby providing an individual pocket for each of the user's toes. It is to be appreciated that embodiments with three or four pockets, in which two toes would be housed in single pocket, are also considered to be within the scope of the present invention.

In light of the foregoing disclosure of the invention and description of the preferred embodiments, those skilled in this area of technology will readily understand that various modifications and adaptations can be made without departing from the scope and spirit of the invention. All such modifications and adaptations are intended to be covered by the following claims.

What is claimed is:

1. An article of footwear for sand sports comprising, in combination;

an outsole;

an upper secured to the outsole, having a first toe pocket configured to receive a big toe of a user and a second toe pocket configured to receive at least some of the remaining toes of the user;

a wrap extending around a midfoot portion of the outsole and the upper, and around a heel portion of the upper; and a releasable strap extending over the wrap across an instep of the upper, a first end of the strap being secured to a medial side of the wrap and a second end of the strap is releasably secured to a lateral side of the wrap.

2. The article of footwear of claim 1, wherein the strap is releasably secured to the wrap with a fastener.

3. The article of footwear of claim 2, wherein the fastener is a hook and loop fastener.

4. The article of footwear of claim 3, wherein a hook portion of the hook and loop fastener is secured to one of the strap and the wrap, and a loop portion of the hook and loop fastener is secured to the other of the strap and the wrap.

5. The article of footwear of claim 1, wherein the strap comprises:

a first portion secured to a medial side of the wrap;

a d-ring secured to the first portion; and a second portion having a first end and a second end, the first end being secured to a lateral side of the wrap, the second portion extending through the d-ring and the second end being releasably secured to the first end.

6. The article of footwear of claim 1, wherein the upper is formed of a flexible textile material.

7. The article of footwear of claim 1, wherein the upper is formed of a knit textile and spandex blend.

8. The article of footwear of claim 1, wherein the wrap is formed of knit textile and spandex blend coated with polyurethane.

9. The article of footwear of claim 1, wherein the outsole is formed of neoprene foam.

10. The article of footwear of claim 1, further comprising a plurality of cleats secured to a lower surface of the outsole.

11. The article of footwear of claim 10, wherein at least some of the cleats have a concave sidewall.

12. The article of footwear of claim 10, wherein at least some of the cleats are formed of a thermoplastic polymer.

13. The article of footwear of claim 10, wherein at least some of the cleats are adhesively secured to the outsole.

14. The article of footwear of claim 10, wherein at least some of the cleats are molded with the outsole.

15. The article of footwear of claim 10, comprising a pair of cleats positioned on a lateral side of a heel portion of the outsole and a pair of cleats positioned on a medial side of the heel portion of the outsole.

16. The article of footwear of claim 10, wherein the cleats have a substantially rectangular shape.

17. The article of footwear of claim 16, wherein at least some of the cleats have a concave sidewall.

18. The article of footwear of claim 16, further comprising:

a first pair of cleats positioned on a lateral side of a heel portion of the outsole, a longitudinal axis of each of the first pair of cleats extending substantially parallel with a lateral edge of the heel portion; and a second pair of cleats positioned on a medial side of the heel portion of the outsole, a longitudinal axis of each of the second pair of cleats extending substantially parallel with a medial edge of the heel portion.

19. The article of footwear of claim 16, further comprising:

a third pair of cleats positioned on a medial side of a forefoot portion of the outsole forwardly of the wrap, a longitudinal axis of each of the second pair of cleats extending substantially parallel with a medial edge of the forefoot portion;

a first medial cleat positioned inwardly of a rearmost cleat of the third pair of cleats, the first medial cleat extending inwardly from its rear end at an angle with respect to the medial edge of the forefoot portion;

a second medial cleat positioned forwardly of the third pair of cleats, a longitudinal axis of the second medial cleat extending substantially perpendicular to the medial edge of the forefoot portion;

a first lateral cleat positioned on a lateral side of the forefoot portion of the outsole forwardly of the wrap, a longitudinal axis of the first lateral cleat extending substantially parallel with a lateral edge of the forefoot portion;

a second lateral cleat positioned forwardly of the first lateral cleat, the second lateral cleat extending inwardly from its rear end at an angle with respect to the lateral edge of the forefoot portion;

a third lateral cleat positioned forwardly of the second lateral cleat, a longitudinal axis of the third lateral cleat extending substantially perpendicular to the lateral edge of the forefoot portion; and a fourth lateral cleat positioned forwardly of the third lateral cleat, the fourth lateral cleat extending inwardly from its rear end at an angle with respect to the lateral edge of the forefoot portion.

20. The article of footwear of claim 10, wherein at least some of the cleats have a central core having a hardness higher than a remainder of the cleat.

21. The article of footwear of claim 10, wherein at least some of the cleats have a plurality of protrusions on an outer surface thereof.

22. The article of footwear of claim 21, wherein the protrusions take the form of ridges.

23. The article of footwear of claim 22, wherein each ridge extends substantially parallel to a longitudinal axis of the cleat.

24. The article of footwear of claim 22, wherein each ridge extends substantially perpendicular to a longitudinal axis of the cleat.

25. The article of footwear of claim 1, further comprising a collar positioned on an upper edge of the upper.

26. The article of footwear of claim 25, further comprising a polymer coating on an interior surface of the collar.

27. The article of footwear of claim 1, wherein the upper is secured to the outsole with stitching.

28. The article of footwear of claim 27, further comprising a protective coating applied to the stitching.

29. The article of footwear of claim 1, further comprising three additional toe pockets, each of the toe pockets configured to receive a toe of the user.

30. The article of footwear of claim 1, further comprising a coating on a top surface of the toe pockets.

31. The article of footwear of claim 30, wherein the coating is one of polyurethane and silicone.

32. The article of footwear of claim 1, further comprising a coating on the wrap.

33. The article of footwear of claim 32, wherein the coating is one of polyurethane and silicone.

34. The article of footwear of claim 1, further comprising a coating on a bottom surface of the toe pockets.

35. The article of footwear of claim 34, wherein the coating is one of polyurethane and silicone.

36. An article of footwear for sand sports comprising, in combination;

an outsole;

an upper secured to the outsole, and having a first toe pocket configured to receive a big toe of a user and a second toe pocket configured to receive at least some of the remaining toes of the user;

a wrap extending around a midfoot portion of the outsole and the upper, and around a heel portion of the upper; and a strap having a first end secured to a medial side of the wrap and a second end releasably secured to a lateral side of the wrap.

37. The article of footwear of claim 36, further comprising a plurality of cleats secured to the outsole.

38. The article of footwear of claim 36, wherein the strap is releasably secured to the wrap with a fastener.

39. The article of footwear of claim 38, wherein the fastener further is a hook and loop fastener.

40. The article of footwear of claim 36, further comprising a collar positioned on an upper edge of the upper.

41. An article of footwear for sand sports comprising, in combination;

an outsole;

an upper secured to the outsole, and having a first toe pocket configured to receive a big toe of a user and a second toe pocket configured to receive at least some of the remaining toes of the user;

a collar positioned on an upper edge of the upper;

a polymer coating on an interior surface of the collar;

a wrap extending around a midfoot portion of the outsole and the upper, and around a heel portion of the upper;

a strap having a first end secured to a medial side of the wrap and a second end releasably secured to a lateral side of the wrap by a fastener; and a plurality of cleats secured to the outsole.

42. The article of footwear of claim 41, wherein the fastener is a hook and loop fastener.

* * * * *